US006082813A

United States Patent [19]

Chen

[11] Patent Number: 6,082,813

[45] Date of Patent: Jul. 4, 2000

[54] FOLDABLE CHAIR

[76] Inventor: Kao-San Chen, No. 282, Sec.2, Shu-Lin St., Tainan City, Taiwan

[21] Appl. No.: 09/382,517

[22] Filed: Aug. 25, 1999

[30] Foreign Application Priority Data

Jun. 5, 1999 [TW] Taiwan ..... 88209218

[51] Int. Cl.[7] ..... A47C 4/28

[52] U.S. Cl. ..... 297/16.2; 297/16.1; 297/36; 297/35; 297/45; 297/42; 297/440.24

[58] Field of Search ..... 297/16.2, 16.1, 297/36, 35, 45, 42, 440.24

[56] References Cited

U.S. PATENT DOCUMENTS

| | | | |
|---|---|---|---|
| 398,943 | 3/1889 | Crandall | 297/45 |
| 703,077 | 6/1902 | Nivison | 297/45 X |
| 1,185,568 | 5/1916 | Zeunert | 297/45 X |
| 1,381,136 | 6/1921 | Ribeiro | 297/16.2 X |
| 1,795,911 | 3/1931 | Walker | 297/45 X |
| 1,942,112 | 1/1934 | McQuilkin | 297/45 |
| 2,104,255 | 1/1938 | Garbaccio | 297/45 |
| 2,713,385 | 7/1955 | McQuilkin | 297/45 |
| 4,645,260 | 2/1987 | Harty et al. | 297/45 X |
| 5,058,950 | 10/1991 | Mann | 297/16.2 X |
| 5,984,406 | 11/1999 | Lee | 297/16.2 |

FOREIGN PATENT DOCUMENTS

| | | | |
|---|---|---|---|
| 551535 | 6/1952 | Belgium | 297/45 |
| 3227119 | 2/1983 | Germany | 297/45 |
| 6-197821 | 7/1994 | Japan | 297/16.2 |
| 215551 | 5/1924 | United Kingdom | 297/45 |
| 635530 | 4/1950 | United Kingdom | 297/45 |

*Primary Examiner*—Peter M. Cuomo
*Assistant Examiner*—Rodney B. White

[57] ABSTRACT

A foldable chair includes four supporting legs, each having a top portion, a bottom portion, and an intermediate portion, and four stretchers, each disposed to brace two adjacent supporting legs. When upper hook ends of the stretchers are slidably moved to a folded position to be proximate to the top portions, the two adjacent supporting legs are closer to each other. Four first coupling members are slidably mounted on the intermediate portions, and are connected to the upper hook ends. Four second coupling members are slidably mounted on the intermediate portions, and are disposed above and are engageable with the first coupling members. A flexible seat sheet is disposed to be grasped by gripping portions of the second coupling members and is tensed when the supporting legs are in the spread position. The length of the first coupling members of the front supporting legs is of a dimension such that, when the supporting legs are in the folded position, the top portions are disposed inwardly of the first coupling members. A pair of armrests are disposed at a desired position between the top portions of the two adjacent rear and front supporting legs for providing a satisfactory feeling of comfort when the chair is in use.

6 Claims, 6 Drawing Sheets

FOLDABLE CHAIR

BACKGROUND OF THE INVENTION

1. Field of the Invention

This invention relates to a foldable chair, more particularly to a foldable chair with four supporting legs which can be placed between spread and folded positions, and a flexible seat sheet which is tensed when in the spread position.

2. Description of the Related Art

Referring to FIGS. 1 and 2, a conventional foldable chair 1 is shown to include two front supporting legs 111, two rear supporting legs 112, four stretchers 13, a flexible seat sheet 14, a flexible backrest sheet 15, and two armrest bands 16.

Each stretcher 13 has two lower anchored ends 121 secured to the bottom portions of two adjacent supporting legs 111,112, and two upper hook ends 122 slidably sleeved on the intermediate portions of the supporting legs 111,112 between a folded position where the upper hook ends 122 are proximate to the top portions of the supporting legs 111,112 and the supporting legs 111,112 are closer to each other, and a spread position where the upper hook ends 122 are distal to the top portions.

The seat sheet 14 has four through holes formed in four corners thereof to sleeve on the supporting legs 111,112, and disposed above the upper hook ends 122.

The backrest sheet 15 is seamed with the seat sheet 14, and forms a loosening slope portion 151 therebetween. The backrest sheet 15 is seamed with two coverings sleeved on the top portions of the rear supporting legs 112.

Each armrest band 16 is secured to the top portions of two adjacent front and rear supporting legs 111,112.

Since the length of the supporting legs 111,112 are required to be a dimension sufficient to allow the upward movement of the upper hook ends 122 to place the supporting legs 111,112 in the folded position, the position of the armrest bands 16 is relatively high, thereby resulting in a feeling of discomfort for the user.

In addition, the seat sheet 14, the backrest sheet 15 and the armrest bands 16 are loosened in the spread position for use, thereby resulting in an unsteady support for the user.

SUMMARY OF THE INVENTION

The object of the present invention is to provide a foldable chair which can provide a satisfactory feeling of comfort when in use.

According to this invention, the foldable chair includes a pair of front right and left supporting legs and a pair of rear right and left supporting legs, each of which has a top portion, a bottom portion, and an intermediate portion interposed therebetween, and four stretchers, each of which is disposed to brace two adjacent supporting legs. Each stretcher includes a pair of lower anchoring ends secured to two adjacent bottom portions, and a pair of upper hook ends retainingly slidable to two corresponding intermediate portions. Each upper hook end is slidably moved between a folded position where the upper hook end is proximate to the top portion, and where the two adjacent supporting legs are closer to each other, and a spread position where the upper hook end is distal to the top portion. A front pair of first coupling members and a rear pair of first coupling members have tubular members which are slidably mounted on the intermediate portions respectively, and which are connected to the upper hook ends such that each first coupling member will come to a stop and will be retained with the intermediate portion when the supporting legs are placed in the spread position. A front pair of second coupling members and a rear pair of second coupling members are slidably mounted on the intermediate portions, and are disposed above and are engageable with the first coupling members, respectively. Each second coupling member has a gripping portion. A flexible seat sheet is disposed to be grasped by the gripping portions and is tensed when the supporting legs are in the spread position.

In addition, the length of each of the front pair of the first coupling members is of a dimension such that, when the supporting legs are in the folded position, the corresponding top portion is confined by and is disposed inwardly of the first coupling member. As such, a pair of armrests are disposed at a desired position between the top portions of the two adjacent rear and front supporting legs for providing a satisfactory feeling of comfort when the chair is in use.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
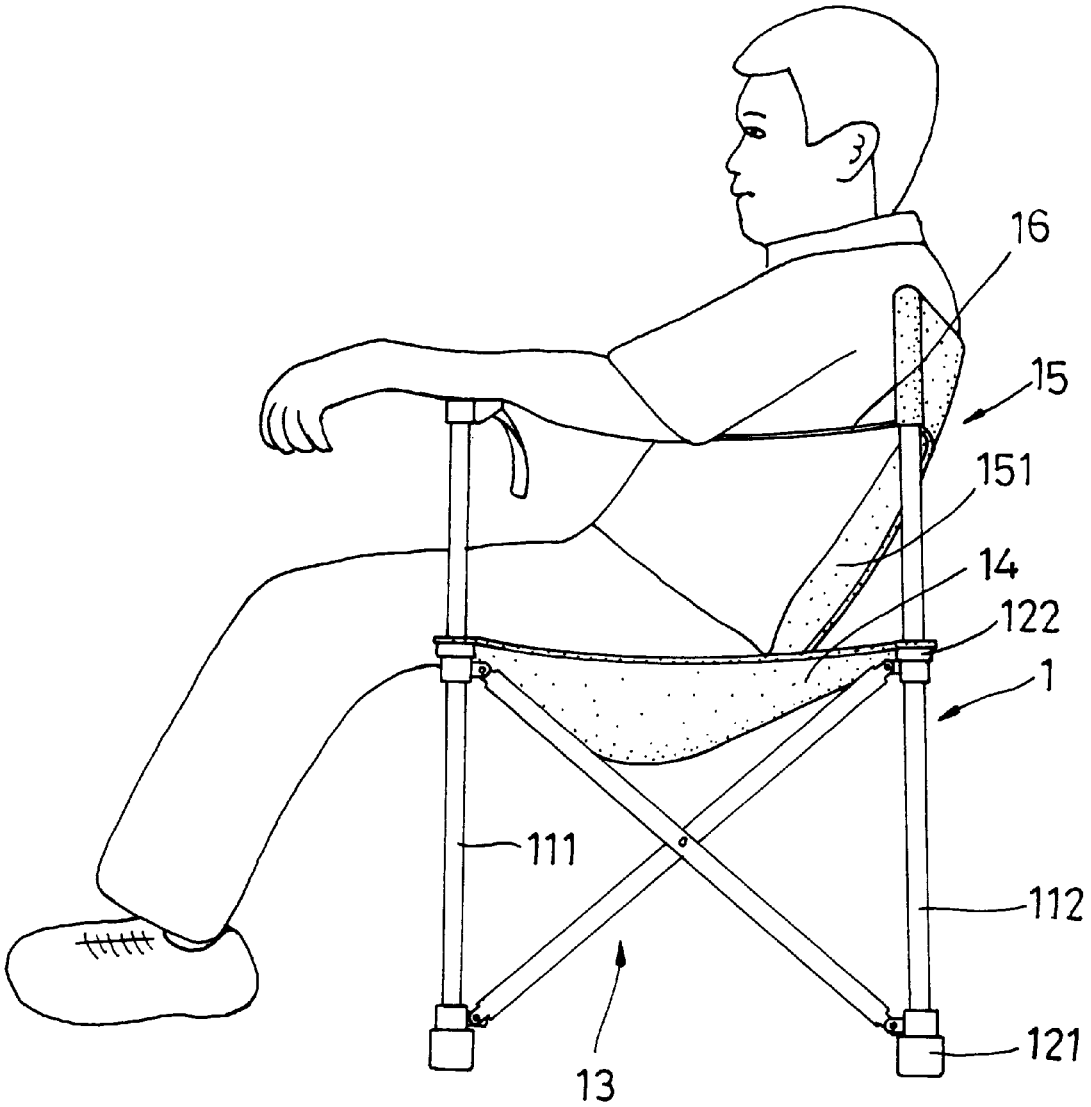
FIG. 1 PRIOR ART
FIG. 1 is a side schematic view of a conventional foldable chair in use.
Figure 2:
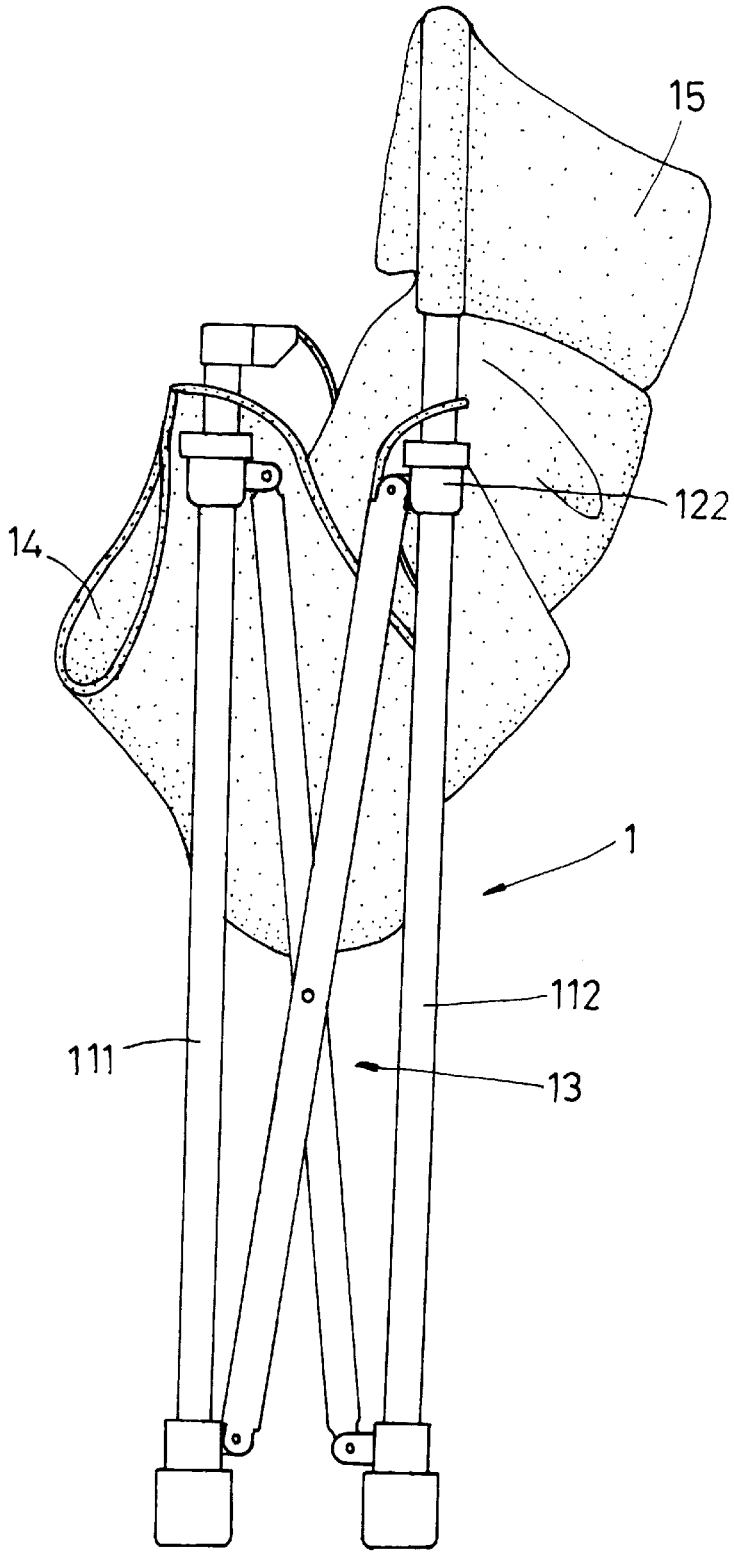
FIG. 2 PRIOR ART
FIG. 2 is a side schematic view of the conventional foldable chair in a folded state.
Figure 3:
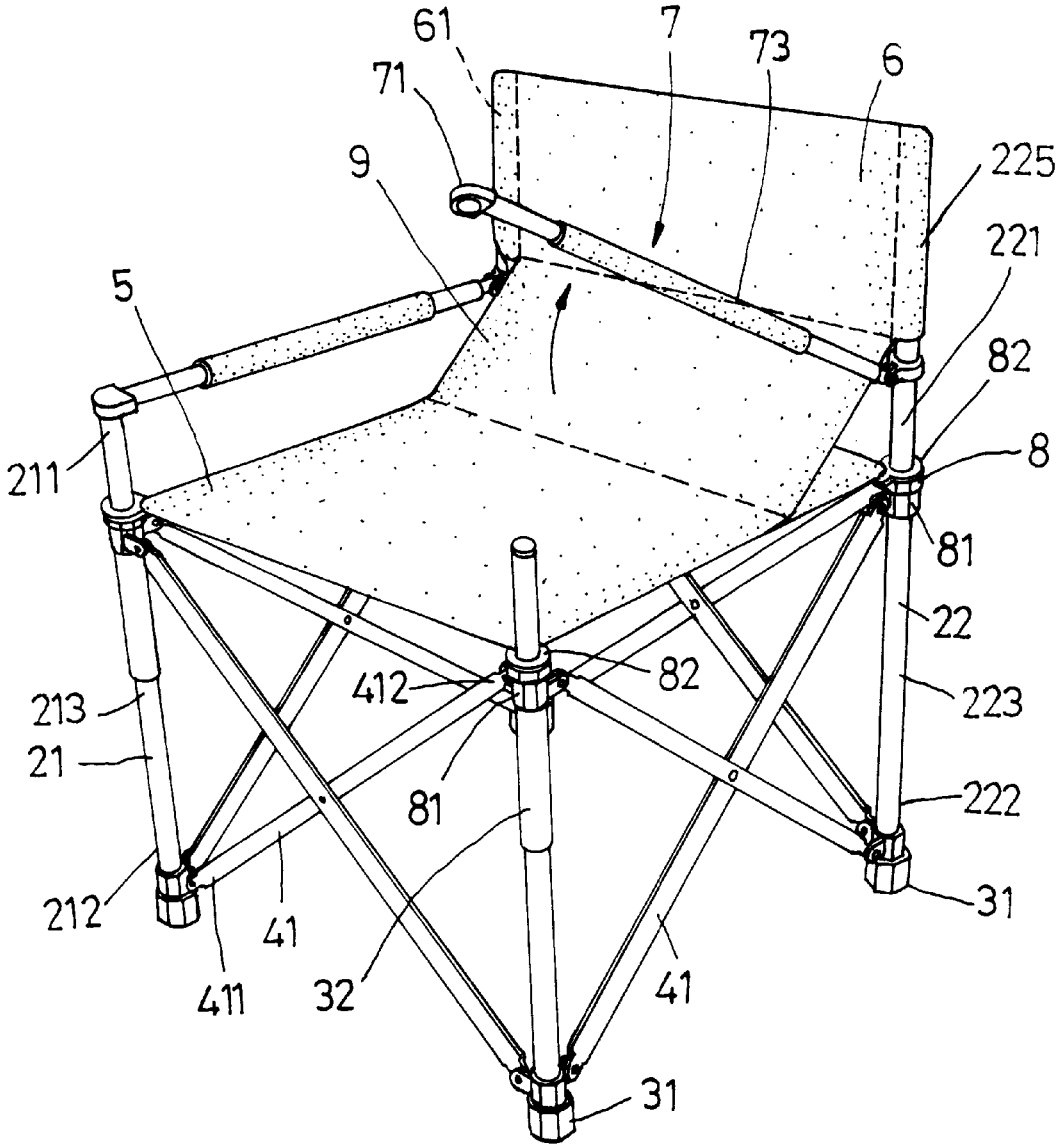
FIG. 3 is a perspective view of a preferred embodiment of a foldable according to this invention in a spread state.
Figure 4:
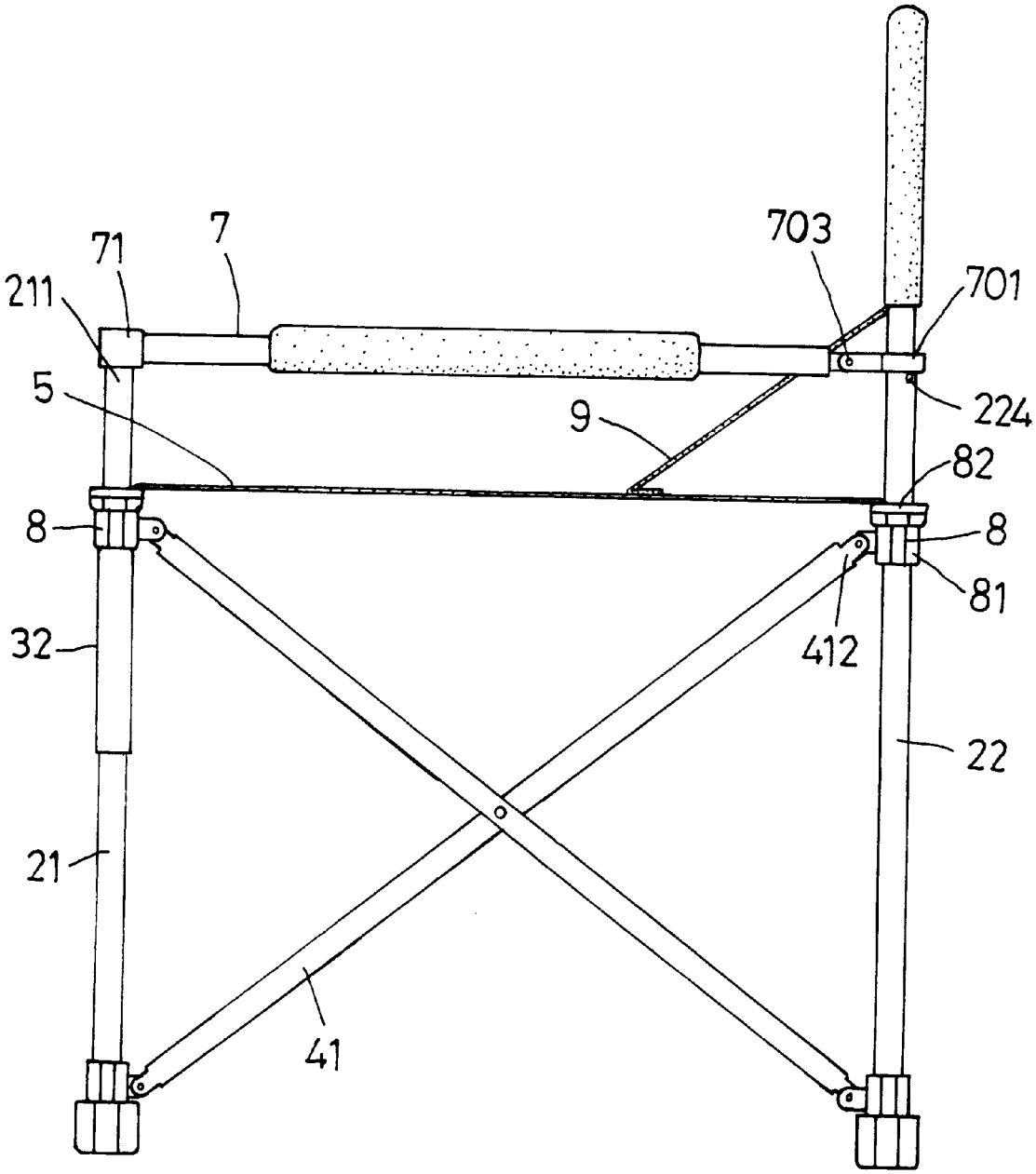
FIG. 4 is a side view of the preferred embodiment of FIG. 3.

Referring to FIGS. 3 and 4, the preferred embodiment of the foldable chair according to the present invention is shown to comprise a pair of front right and left supporting legs 21, a pair of rear right and left supporting legs 22, four stretchers 41, a front pair of coupling units and a rear pair of coupling units 8, a flexible seat sheet 5, a pair of armrests 7, and a flexible backrest sheet 6.

The front right and left supporting legs 21 are disposed to be spaced apart from each other in a longitudinal direction. Each of the front right and left supporting legs 21 has a top portion 211, a bottom portion 212, and an intermediate portion 213 interposed therebetween.

Figure 5:
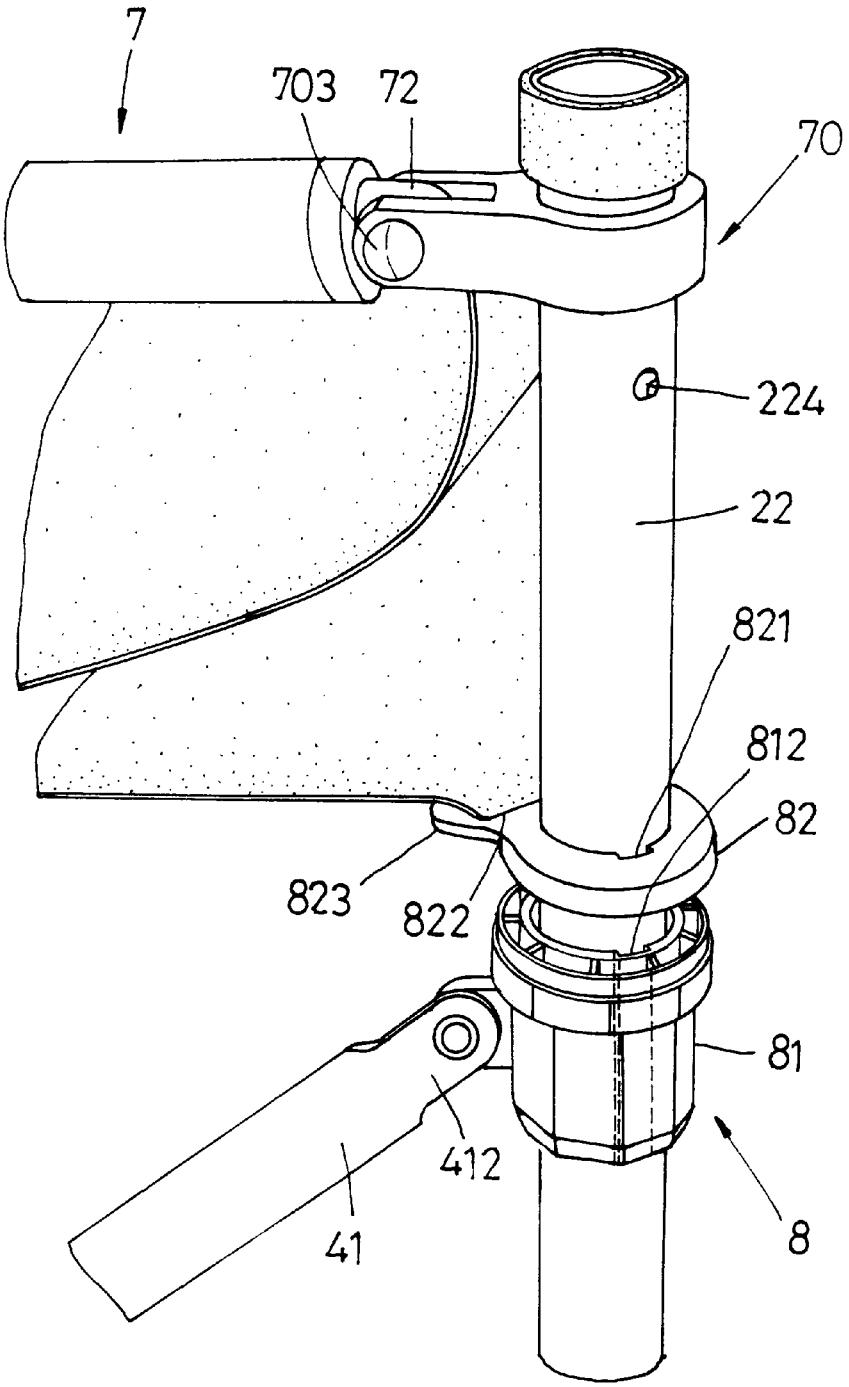
FIG. 5 is a fragmentary perspective view of the preferred embodiment showing first and second coupling members on a rear supporting leg.

The pair of rear right and left supporting legs 22 are disposed to be spaced apart from each other in the longitudinal direction. Each of the rear right and left supporting legs 22 has a top portion 221, a bottom portion 222, and an intermediate portion 223 interposed therebetween. The rear right and left supporting legs 22 are respectively spaced from the front right and left supporting legs 21 in a first transverse direction relative to the longitudinal direction. In addition, a pair of stile members 225 are integrally formed with, and extend uprightly from the top portions 221, respectively. As shown in FIG. 5, a pair of stop members 224 are disposed respectively on the intermediate portions 223 proximate to the top portions 221.

Figure 6:
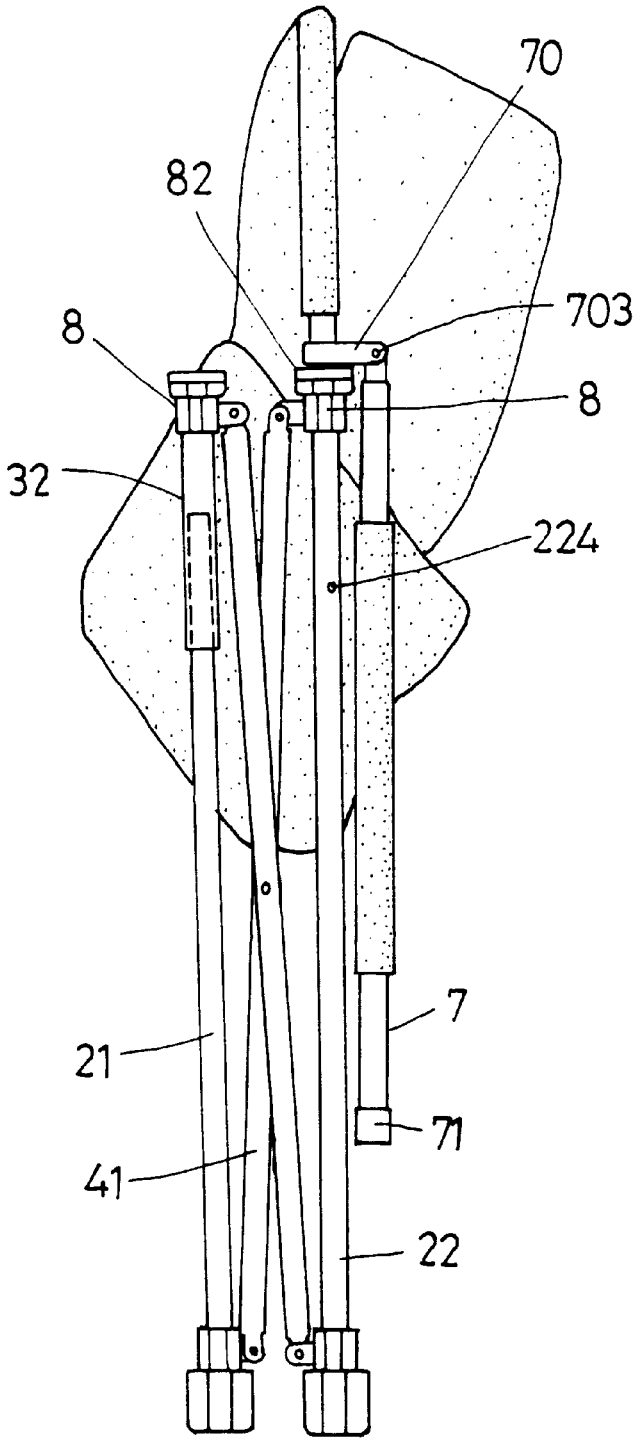
FIG. 6 is a side schematic view of the preferred embodiment in a folded state.

Each stretcher 41 is disposed to brace two adjacent ones of the front right and left supporting legs 21 and the rear right and left supporting legs 22 in either one of the longitudinal direction and the first transverse direction. Each stretcher 41 includes a pair of lower anchoring ends 411 which are secured relative to two corresponding ones of the bottom portions 212,222 of the two adjacent ones of the supporting legs 21,22, by means of bottom coupling elements 31, respectively. Each stretcher 41 further includes a pair of upper hook ends 412 which are retainingly slidable relative to two corresponding ones of the intermediate portions 213,223 of the two adjacent ones of the supporting legs 21,22, respectively (a detailed description of the construction will be provided hereinafter). As such, each of the upper hook ends 412 is movable slidably between a folded position where a corresponding one of the upper hook ends 412 is proximate to a respective one of the top portions 211,221, and where the two respective adjacent supporting legs 21,22 are closer to each other (as shown in FIG. 6), and a spread position where each upper hook end 412 is distal to the respective top portion 211,221 (as shown in FIGS. 3 and 4).

The front pair of coupling units 8 includes a front pair of first coupling members 81 and a front pair of second coupling members 82. The rear pair of first coupling members 8 includes a rear pair of first coupling members 81 and the rear pair of second coupling member 82.

With reference to FIG. 5, each first coupling member 81 has a tubular member which is sleeved slidably on a respective intermediate portion 213,223, and is connected to a respective upper hook end 412. Thus, when the supporting legs 21,22 are placed in the spread position, each first coupling member 81 will come to a stop and will be retained with the corresponding intermediate portion 213,223. In addition, each of the front pair of first coupling members 81 has a tubular member 32 which is elongated in a second transverse direction that is transverse to both the first transverse direction and the longitudinal direction such that when the supporting legs 21,22 are in the folded position, the corresponding top portion 211 is confined by and is disposed inwardly of the tubular member 32, as shown in FIG. 6.

Each second coupling member 82 is slidably mounted on the respective intermediate portion 213,223, and is disposed above and is engageable with the respective first coupling member 81 in the second transverse direction. Each second coupling member 82 includes a gripping portion 823 with a slit 822 formed therein. Moreover, as shown in FIG. 5, the first and second coupling members 81,82 have first and second grooves 812,821 therein which extend and which are aligned with each other in the second transverse direction, and which face the corresponding intermediate portions 213,223.

The seat sheet 5 is disposed to be grasped by the gripping portions 823 in such a manner that the seat sheet 5 is seamed with four corner portions respectively passing through the slits 822. As such, when the supporting legs 21,22 are in the spread position, the seat sheet 5 is tensed in both the longitudinal and first transverse directions. The seat sheet 5 may have two flexible bands (not shown) seamed on a bottom thereof or connected to the gripping portions 823 for increasing the tension of the seat sheet 5.

Each armrest 7 includes a lug end 70 which is slidably and rotatably mounted on the respective top portion 221 of the rear right and left supporting legs 22, and an armrest body which has a proximate portion 72 that is pivotally mounted to the lug end 70, and a distal portion 71 that is disposed to cap the corresponding top portion 211 of the front right and left supporting legs 21. A rivet fastener 703 is inserted into the lug end 70 and the proximate end 72 so as to secure the angular position of the armrest body relative to the lug end 70. A cushion member 73 is sleeved on the armrest body.

The backrest sheet 6 is formed via seaming with two lateral coverings 61 which are spaced apart from each other in the longitudinal direction so as to cover the stile members 225, respectively. When the supporting legs 21,22 are in the spread position, the backrest sheet 6 is being tensed in the longitudinal direction. In addition, the backrest sheet 6 includes a lower edge portion which extends in the longitudinal direction and which is seamed with the seat sheet 5 along a line parallel to the longitudinal direction so as to form a slope portion 9 therebetween. The slope portion 9 is tensed when the supporting legs 21,22 are in the spread position for supporting the user's waist. In addition, the slope portion 9 may be seamed with a pocket (not shown).

Referring to FIGS. 4 and 6, when it is desired to fold the foldable chair, the distal ends 71 of the armrests 7 are first pulled upwardly of the top portions 211 so as to swing downwardly about the lug ends 70. Then, the supporting legs 21,22 are moved closer to one another to the folded position, and the coupling units 8 are slid upwardly along with the upper hook ends 412 proximate to the top ends 211,221 and the coupling units 8 of the rear right and left supporting legs 22 pass through the stop members 224 by virtue of the first and second grooves 812,821 until the stretchers 41 are placed almost uprightly, as shown in FIG. 6. At this time, by virtue of the elongated tubular members 32, the front pair of the first coupling members 81 can be retained to engage the top portions 211. Consequently, the length of the front right and left supporting legs 21 can be of a dimension such that the position of the armrests 7 in the second transverse direction can give comfort to the user.

In addition, the rear right and left supporting legs 22 may further extend upwardly from the stile members 225 in the transverse direction for mounting a headrest sheet (not shown) . Moreover, since the seat sheet 5, the backrest sheet 6 and the slope portion 9 are tensed when the supporting legs 21,22 are in the spread position, and since the armrests 7 are made of a rigid material, a satisfactory feeling of comfort can be provided to the user.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A foldable chair comprising:

a pair of front right and left supporting legs disposed to be spaced apart from each other in a longitudinal direction, each of said front right and left supporting legs having a top portion, a bottom portion, and an intermediate portion interposed therebetween;

a pair of rear right and left supporting legs disposed to be spaced apart from each other in the longitudinal direction, each of said rear right and left supporting legs having a top portion, a bottom portion, and an intermediate portion interposed therebetween, said rear right and left supporting legs being respectively spaced from said front right and left supporting legs in a first transverse direction relative to the longitudinal direction;

four stretchers, each disposed to brace two adjacent ones of said front right and left supporting legs and said rear right and left supporting legs in either one of the longitudinal direction and the first transverse direction, each stretcher including a pair of lower anchoring ends secured relative to two corresponding ones of said bottom portions of said two adjacent ones of said supporting legs, respectively, and a pair of upper hook ends retainingly slidable relative to two corresponding ones of said intermediate portions of said two adjacent ones of said supporting legs, respectively, wherein each of said upper hook ends is movable slidably between a folded position where a corresponding one of said upper hook ends is proximate to a respective one of said top portions, and where said two respective adjacent supporting legs are closer to each other, and a spread position where said corresponding one of said upper hook ends is distal to said respective one of said top portions;

a front pair of first coupling members and a rear pair of first coupling members, each having a tubular member sleeved slidably on a respective one of said intermediate portions, and connected to a respective one of said upper hook ends such that each of said first coupling members will come to a stop and will be retained with a corresponding one of said intermediate portions when said supporting legs are placed in said spread position, a length of each of said front pair of said tubular members in the second transverse direction being of a dimension such that when said supporting legs are in said folded position, a corresponding one of said top portions of said front right and left supporting legs is confined by and is disposed inwardly of said tubular member;

a front pair of second coupling members and a rear pair of second coupling members, each slidably mounted on said corresponding one of said intermediate portions, and disposed above and engageable with a respective one of said first coupling members in a second transverse direction that is transverse to both the first transverse direction and the longitudinal direction, each of said second coupling members including a gripping portion;

a flexible seat sheet disposed to be grasped by said gripping portions such that when said supporting legs are in said spread position, said flexible seat sheet is tensed in both the longitudinal and first transverse directions; and a pair of armrests, each including a lug end mounted slidably on a respective one of said top portions of said rear right and left supporting legs, and an armrest body having a proximate portion movable pivotally relative to said lug end, and a distal portion capping a corresponding one of said top portions of said front right and left supporting legs.

2. The foldable chair according to claim 1, further comprising a pair of stop members disposed respectively on said intermediate portions of said rear right and left supporting legs proximate to said top portions to restrict said lug ends respectively from downward movement.

3. The foldable chair according to claim 2, wherein each of said first coupling members and a corresponding one of said second coupling members respectively include first and second grooves therein extending and aligned with each other in the second transverse direction, and facing a corresponding one of said intermediate portions so as to allow said first and second coupling members to pass over said stop members when said supporting legs are being placed in said folded position.

4. The foldable chair according to claim 3, further comprising a pair of stile members integrally formed with, and extending uprightly from said top portions of said rear right and left supporting legs, respectively.

5. The foldable chair according to claim 4, further comprising a flexible backrest sheet formed via seaming with two lateral coverings spaced apart from each other in the longitudinal direction so as to be brought to cover said stile members respectively, and disposed to be such that when said supporting legs are in said spread position, said backrest sheet is tensed in the longitudinal direction.

6. The foldable chair according to claim 5, wherein said flexible backrest sheet includes a lower edge portion extending in the longitudinal direction and seamed with said flexible seat sheet along a line parallel to the longitudinal direction so as to form a slope portion therebetween, said slope portion being tensed when said supporting legs are in said spread position.

* * * * *